United States Patent [19]

Seneviratne

[11] 4,367,056

[45] Jan. 4, 1983

[54] MARINE PLATFORM JACKET JACK

[75] Inventor: Padmasiri D. Seneviratne, Fullerton, Calif.

[73] Assignee: Varco International, Inc., Orange, Calif.

[21] Appl. No.: 227,735

[22] Filed: Jan. 23, 1981

[51] Int. Cl.[3] ..... E02D 13/00

[52] U.S. Cl. ..... 405/228; 254/106; 254/29 R; 405/224; 405/232

[58] Field of Search ..... 405/195–209, 405/224–228; 254/29 R, 106, 107; 269/48.1

[56] References Cited

U.S. PATENT DOCUMENTS

| | | | |
|---|---|---|---|
| 2,841,961 | 7/1958 | Lucas | 405/199 |
| 2,969,648 | 1/1961 | Rechtin | 405/199 X |
| 3,007,317 | 11/1961 | Suderow | 405/196 |
| 3,008,691 | 11/1961 | Steele et al. | 254/106 |
| 3,171,259 | 3/1965 | Roussel | 405/199 |
| 3,233,315 | 2/1966 | Levake | 254/29 R X |
| 3,396,945 | 8/1968 | Schreier et al. | 405/199 X |
| 3,495,806 | 2/1970 | Sutton | 405/198 |
| 3,804,369 | 4/1974 | Sutton | 405/196 |
| 3,869,003 | 3/1975 | Yamada et al. | 254/29 R X |

*Primary Examiner*—Dennis L. Taylor
*Attorney, Agent, or Firm*—William P. Green

[57] ABSTRACT

A jacking mechanism for leveling a marine platform and a jacket supporting the platform by elevating a tubular leg or member of the platform relative to a pile extending through that member, with the jacking mechanism including a first gripping unit adapted to extend about and releasably grip the tubular member, a second gripping unit adapted to extend about and releasably grip the pile at a location beyond the tubular member and at a diameter smaller than the diameter at which the first gripping unit engages the tubular member, and power actuated means for moving the two gripping units axially relative to one another to cause the desired relative displacement of the leg and pile.

18 Claims, 6 Drawing Figures

FIG. 6
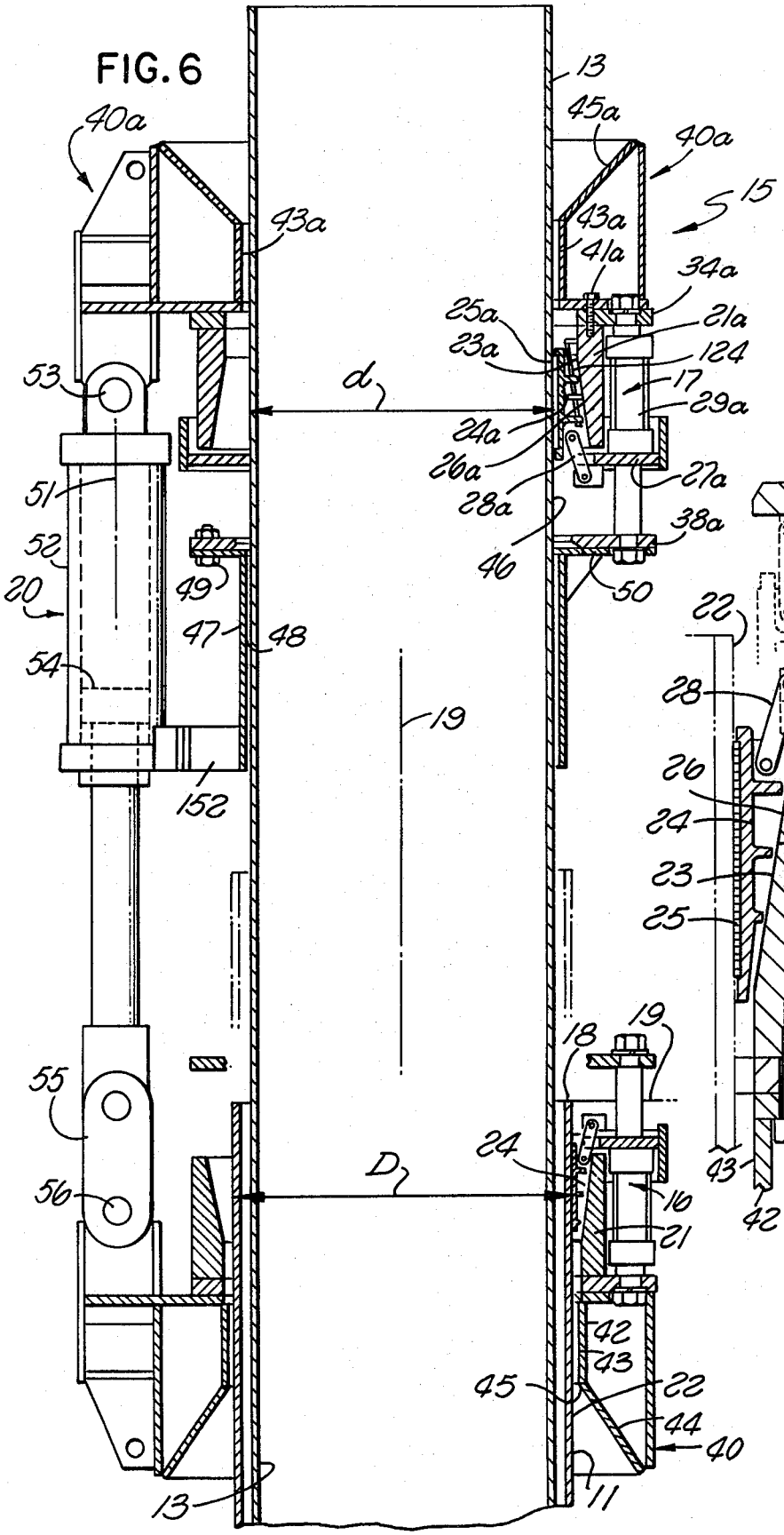
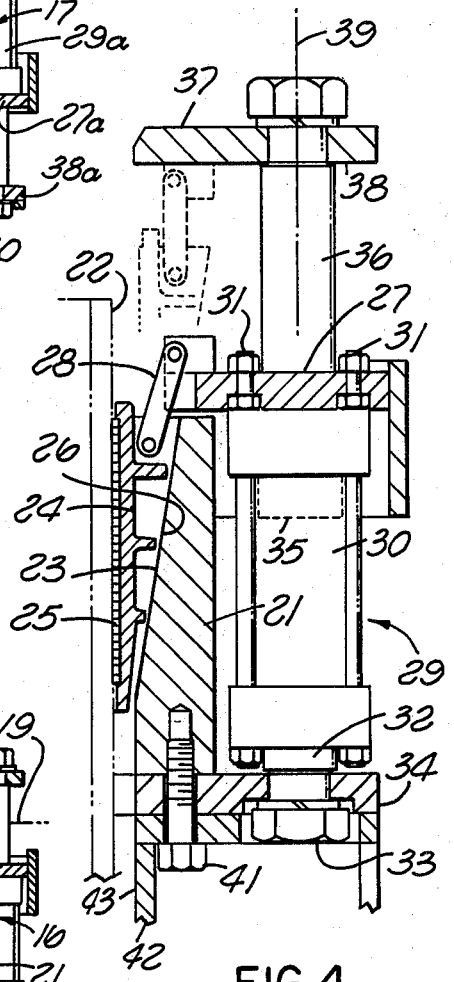
FIG. 4

MARINE PLATFORM JACKET JACK

BACKGROUND OF THE INVENTION

This invention relates to improved jacking apparatus for use in leveling a marine well drilling platform or the like.

Marine platforms are normally supported on 'jacket' structures which form a framework projecting downwardly beneath the platform and resting on the bed of the ocean or other body of water in which the platform is located. The jacket has tubular portions forming legs or guides through which piles are driven downwardly into the soil formation beneath the body of water, to anchor the jacket and platform in fixed position.

After the piles have been driven through the tubular members of the jacket and into the earth formation, the platform may be adjusted to a precisely level or horizontal condition by raising one side of the platform relative to the associated piles, and then applying grout between the piles and tubular members to retain the platform in its level condition. A jacking mechanism has heretofore been devised for performing this leveling operation, consisting of a gripping unit which is receivable about and adapted to grip the pile and which is connected by power cylinders to lugs or pad eyes projecting outwardly from the tubular member, in a relation enabling the power cylinders to pull the tubular member upwardly relative to the gripping unit and the pile engaged thereby and to a desired platform leveling condition. The power cylinders in that apparatus are carried by a sleeve received about the pile above the upper end of the tubular member.

SUMMARY OF THE INVENTION

The present invention provides an improved jacking mechanism which is usable for the above discussed purpose of leveling a marine platform, or for other similar purposes, and which is adapted to be more quickly and easily applied to a jacket and pile assembly, and to perform the overall leveling operation in a shorter period of time than the prior device. In particular, a jacking device constructed in accordance with the invention is capable of exerting relative axial jacking force against a pile and a tubular member disposed thereabout without the necessity for welding connector lugs or eyes to the tubular member or making other similar connections to the tubular member. Instead, the jacking device can simply be moved to a position of reception about both the tubular member and a portion of the coacting pile, and without structural alteration of either of those parts can be actuated against the tubular member and pile in a manner forming effective releasable force transmitting connections thereto. The jack can then be actuated to move the tubular member and pile relative to one another, and after the parts have been grouted to form a permanent connection therebetween in the properly leveled condition, the jack can be easily removed from the parts, again without any alteration of their structure.

To achieve these results, a device embodying the invention includes a first gripping unit which is receivable about one of the tubular legs or members of a jacket and which is adapted to grip the outer surface of the tubular member in a manner exerting upward lifting force thereagainst, and a second gripping member adapted to extend about the pile at a location above the tubular member and to grip the pile at a diameter less than the diameter of the outer surface of the tubular member which is engaged by the first gripping unit. Power actuated means associated with the two gripping units and preferably taking the form of a number of piston and cylinder mechanisms are actuable to effect displacement of the first gripping unit upwardly relative to the second gripping unit in a manner jacking the tubular member and jacket and platform upwardly relative to the pile. Each of the gripping units is actuable between an active condition of gripping engagement with the tubular member or pile contacted thereby and a released position permitting axial movement of the gripping unit relative to the associated part. The gripping units are desirably slip type mechanisms, including tapered slip elements engaging slip bowl structures in camming relation to wedge the slips tightly against the contacted parts. The main power cylinders or other powered actuating means for moving the two gripping units axially relative to one another may be carried and located by a sleeve disposed about the pile or tubular member at a location axially between the two gripping units.

BRIEF DESCRIPTION OF THE DRAWINGS

The above and other features and objects of the invention will be better understood from the following detailed description of the typical embodiment illustrated in the accompanying drawings, in which:

FIG. 4 is a fragmentary vertical section taken on line 4—4 of FIG. 3;

FIG. 6 is an axial sectional view taken on line 6—6 of FIG. 3.

DESCRIPTION OF THE PREFERRED EMBODIMENT

Figure 1:
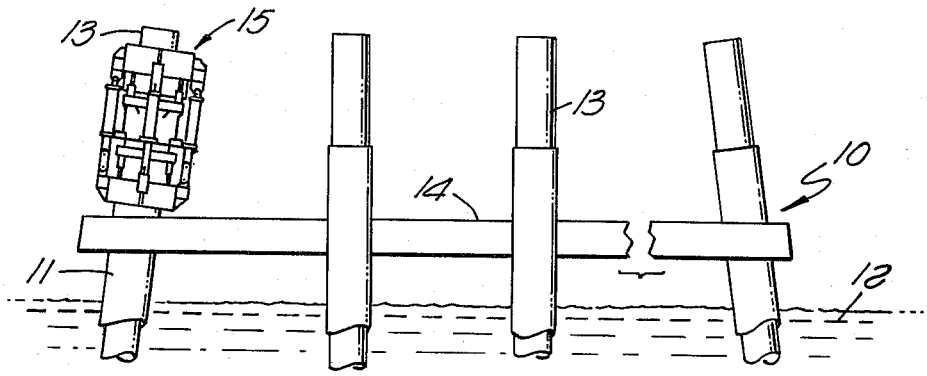
FIG. 1 is a diagrammatic representation of the upper portion of a marine platform jacket and pile assembly with a leveling device embodying the invention positioned for jacking one of the legs of the jacket upwardly relative to a pile which extends through the leg.
Figure 3:
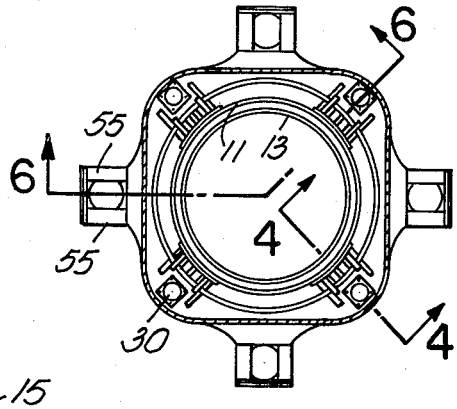
FIG. 3 is a horizontal section taken on line 3—3 of FIG. 2.

In FIG. 1, there is represented somewhat diagrammatically at 10 a marine platform jacket including a number of tubular legs 11 which extend downwardly through the body of water 12 to the bed or earth formation beneath that body of water, and which initially rest on the seabed to support the jacket therefrom. Legs 11 may be formed of sections of pipe which are internally and externally cylindrical and preferably of uniform diameter along their entire length. A number of piles 13 are driven downwardly through legs 11 and into the seabed to firmly anchor the structure in fixed position relative to that bed. These piles may be formed of tubular sections of pipe of an external diameter to fit fairly closely within the internal diameter of legs 11, while leaving some space radially therebetween within which grout is ultimately filled to lock the jacket in fixed position relative to the piles.

If the jacket as initially placed on the seabed is in a position such that a platform 14 supported by the jacket is not exactly level, a jacking mechanism 15 embodying the invention can be utilized for raising one side of the jacket and platform relative to the other side to attain a precisely level condition. This jacking device is illustrated in FIG. 1 as positioned about the upper end portion of one of the tubular jacket legs 11 and the upper portion of a pile 13 extending through the leg, to apply force in opposite directions against the leg and pile acting to jack the leg upwardly relative to the pile. It is to be understood, however, that in some instances the tubular element 11 with which the jacking mechanism 15 of the invention is utilized may not be a full leg extending the entire distance downwardly to the seabed, but instead may be a shorter tubular pile guide, which is rigidly secured to the remainder of the jacket 10 and through which the pile is driven in locating and guided relation. It is also contemplated that the structure which includes the tubular element or elements 11 and which is leveled by the jacking device 15 of the present invention may be a marine platform template, and consequently the term "jacket" as used in this application is to be considered broadly as having reference to any jacket like structure such as a template.

Figure 2:
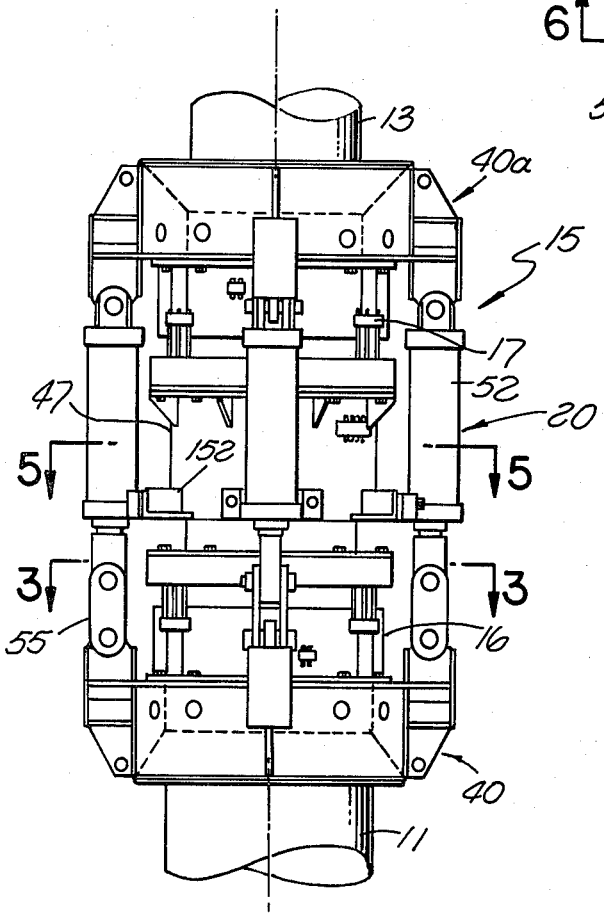
FIG. 2 is an enlarged elevational view of the leveling tool of FIG. 1, with the pile and leg illustrated in vertical rather than slightly inclined position for ease of illustration.
Figure 5:
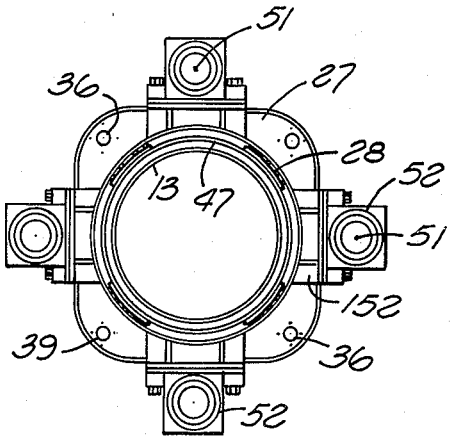
FIG. 5 is a horizontal section taken on line 5—5 of FIG. 2.

As seen best in FIGS. 2 and 6, the jack 15 includes a lower gripping unit 16 received about and adapted to releasably grip an upper end portion of the tubular leg or pile guide 11 and an upper gripping unit 17 received about and adapted to releasably grip pile 13 at a location above the upper extremity 18 of leg 11. The upper end surface 18 of leg 11 is cut off in a plane disposed transversely of the longitudinal axis 19 of elements 11 and 13. Gripping unit 17 is actuable upwardly and downwardly relative to lower gripping unit 16 by a number of evenly circularly spaced piston and cylinder mechanisms 20.

The lower gripping assembly 16 includes an essentially annular rigid body 21 of a diameter to be received about the outer cylindrical surface 22 of leg 11. This body 21 functions as a slip bowl structure, having inner camming surfaces 23 which taper conically to a reduced diameter with respect to axis 20 of the body as they advance downwardly. A series of slips 24 received within body 21 at circularly spaced locations have inner gripping faces 25 curved essentially in correspondence with the outer cylindrical surface 22 of leg 11 and provided with teeth acting to grip that surface in a relation applying upward lifting force to leg 11. The slips have outer camming surfaces 26 which engage surfaces 23 of the slip bowl body 21 and taper conically in correspondence therewith as they advance downwardly, to cam the slips tightly radially inwardly against leg 11 and into gripping engagement therewith upon exertion of upward force against body 21 to jack leg 11 upwardly relative to the pile.

The slips 24 are adapted to be power actuated axially relative to the slip bowl body 21 between the full line gripping position of FIG. 4 and the broken line released position of that figure by axial movement of an essentially annular element 27 which extends about the jacket leg 11 and from which the slips are suspended by links 28 pivoted at their opposite ends to element 27 and the slips respectively. In their released broken line positions, the slips can not simultaneously engage both body 21 and surface 22 of the jacket leg and therefore can not be wedged between those elements to communicate upward force from body 21 to the leg, with the result that in the released position of the slips gripping unit 16 is free for movement either upwardly or downwardly relative to leg 11.

Element 27 is actuated axially by a number of evenly circularly spaced piston and cylinder units 29, whose cylinders 30 may be attached to element 27 as by screws 31, and whose piston rods 32 may be rigidly connected at 33 to a part 34 which is rigidly attached by screws 41 to body 21 and forms a flange projecting outwardly therefrom. The pistons 35 within cylinders 30 may also have upwardly projecting piston rods 36 connected to an upper ring 37 at 38 to assist in maintaining the rigidity of the overall structure. The axes 39 of piston and cylinder mechanisms 29 of course extend parallel to the main longitudinal axis 19 of the jack assembly. Piston and cylinder units 29 are double acting, to power actuate the slips in both their upward and downward directions.

A downwardly facing centering guide or bell element 40 is connected rigidly to the lower end of body 21 of gripping unit 16, typically by the same bolts 41 which secure flange part 34 to body 21. The guide element 40 has a tubular portion 42 with a straight cylindrical inner surface 43 of a diameter just slightly greater than the external diameter of jacket leg 11 to locate the connected gripping unit 16 concentrically with respect to the jacket leg. At the lower end of its tubular portion 42, guide 40 has a downwardly flaring portion whose inner frustro-conically flaring annular surface 45 is engageable with the upper end of leg 11 as the jacking mechanism 15 is initially lowered or stabbed into contact with the leg, to thereby deflect or cam mechanism 15 into centered relation with respect to the leg. The internal diameter of inner surface 43 of tubular portion 42 of stabbing guide 40 is just slightly greater than the diameter of the inner gripping surfaces 25 of slips 24 in their lower full line active gripping position of FIG. 4.

The upper gripping unit 17 is very similar to lower gripping unit 16 except that it is reduced in effective gripping diameter for engagement with pile 13, and is also inverted to apply downward force to the pile as against the upward force which is exerted by gripping unit 16 against jacket leg 11. As seen in FIG. 6, gripping unit 17 includes an annular slip bowl body **21*a* having an upwardly tapering camming surface 23*a*, a series of circularly spaced wedging slips 24*a* having inner gripping faces and outer camming surfaces 26*a*, and a number of circularly spaced piston and cylinder mechanisms 29*a* for shifting the slips axially relative to body 21*a* between active gripping positions and released positions in which the gripping unit 17 is free for either upward or downward movement relative to pile 13. As in the case of the lower gripping unit, the cylinders of mechanism 29 may be attached to an essentially annular element 27*a* connected by links 28*a* to the slips, to shift the slips in correspondence with the movement of the cylinders relative to the pistons of units 29*a* whose oppositely directed piston rods may be connected to a flange 34*a* on body 21*a* and an element 38*a***.

Appropriate means may be provided for guiding slips **24*a* to follow the inclination of slip bowl surface 26*a* and advance radially outwardly away from pile 13 as the slips are shifted downwardly to released condition by mechanism 29*a*. These guiding means are typically illustrated as including rods 124 attached rigidly to body 21*a* and extending at an angle to axis 19 corresponding to that of slip bowl surfaces 26*a*, and extending through guide openings in transverse portions of the slips so that the slips can move along and relative to the rods and be guided thereby. If desired, similar guides can be provided for the lower slips 24**.

The internal and external diameter of body 21*a* may be the same as body 21 of gripping unit 16, and the conically tapering wedge surfaces of parts 21*a* and 24*a* may be the same as parts 21 and 24, but with the slips 24*a* having a greater radial thickness than slips 24 so that the inner gripping faces 25*a* of slips 24*a* in their active gripping condition have a diameter d which is less than the corresponding diameter D of slips 24 in their active gripping condition. Surfaces 25*a* of slips 24*a* curve in correspondence with and engage the outer cylindrical surface 46 of pile 13, and are provided with gripping teeth capable of communicating downward force from slips 24*a* to the pile. Except with respect to the differences specifically mentioned above, the various elements 21*a*, 24*a*, 27*a*, 28*a*, 29*a* and 38*a* may be identical with the corresponding elements 21, 24, 27, 28, 29 and 38 of lower gripping unit 16.

At the upper end of gripping unit 17, there is provided a guide element 40*a* which may be essentially the same as lower guide 40 except that the diameters of its inner guide surfaces 43*a* and 45*a* are less than the diameters of surfaces 43 and 45 of part 40 in correspondence with the smaller diameter of pile 13 as compared with tubular leg 11. Cylindrical guide surface 43*a* is just slightly greater in diameter than the outer surface 46 of pile 13, to locate upper gripping assembly 17 coaxially with respect to the pile, and surface 45*a* flares frustro conically upwardly from the diameter of surface 43*a* to an increased diameter to deflect a pile or other element into centered relation with respect to element 40*a* if the pile or a section thereof is inserted into leg 11 after jack 15 has been moved into position. The centering guide 40*a* may be secured to body 21*a* of gripping unit 17 by bolts 41*a*.

Vertically between the two gripping units 16 and 17, the jacking device 15 includes a tubular sleeve 47 having an inner straight cylindrical surface 48 of a diameter just slightly greater than outer surface 46 of pile 13 and centered about the main axis 19 of the jacking device. Inner surface 48 of sleeve 47 is preferably the same diameter as and aligned axially with inner surface 43*a* of the straight cylindrical portion of upper stabbing guide 40*a*. The diameter of these surfaces 48 and 43*a* is also just slightly greater than the effective gripping diameter of inner surfaces 25*a* of slips 24*a* in their active gripping positions. Sleeve 47 may be rigidly secured to body 21*a* of the upper gripping unit, in axial alignment therewith. The attachment of these parts may be made by extension of a series of circularly spaced bolts 49 through element 38*a* and flange 50 welded to and projecting from sleeve 47.

The main piston and cylinder units 20 for moving gripping unit 16 axially relative to gripping unit 17 extend along individual axes 51 parallel to main axis 19 of the device, and are connected at their opposite ends to stabbing guides 40 and 40*a*. The cylinders 52 of each of these mechanisms 20 may have its upper end connected at 53 to upper guide 40*a*, and be rigidly connected near its lower end to a lower end portion of sleeve 47 by a radially extending attaching part 152 welded to cylinders 52 and sleeve 47. The piston 54 of each unit 20 may have its rod connected pivotally at its lower end to a link 55, whose second end is pivoted at 56 to lower guide 40. The cylinders are thus capable of exerting upward force against the lower gripping unit while permitting slight lateral or horizontal shifting movement of the lower unit 16 and guide 40 relative to upper unit 17 and guide 40*a* in the event that leg 11 is not precisely centered relative to pile 13.

In considering a cycle of use of the jack 15, assume that the jacket leg 11 (or a pile guide of the jacket) is initially in the position illustrated in full lines in FIG. 6, and is to be raised relative to pile 11 to the broken line position of FIG. 6. Jack 15, with its piston and cylinder mechanisms 20 extended as shown in FIG. 6, is moved downwardly from above pile 13 into engagement with the pile and leg 11 and to the installed position of FIG. 6. Guide 40 engages both the pile and leg 11 in stabbing relation to center the device relative to the pile and leg. With the jack in its FIG. 6 position, piston and cylinder mechanisms 29 are actuated to move the slips of the two gripping units 16 and 17 from their released positions to their active gripping conditions of engagement with the outer surface of leg 11 and pile 13. Mechanisms 20 are then actuated to exert upward force through lower gripping unit 16 against jacket leg 11, and to exert downward force through upper gripping unit 17 against pile 13, in a relation lifting leg 11 and the remainder of the jacket upwardly along and relative to the pile and to the broken line position of FIG. 6 (full lines in FIG. 2). When the platform is in a properly level condition, the upward jacking action is terminated and the jack 15 and platform are retained in that position while grout is filled into the space annularly between each of the various legs or pile guides 11 of the platform jacket and the pile 13 contained therein, to rigidly connect the jacket to the piles in the adjusted level condition. After setting of the grout, the device 15 can be removed upwardly from about the legs and piles.

While a certain specific embodiment of the present invention has been disclosed as typical, the invention is of course not limited to this particular form, but rather is applicable broadly to all such variations as fall within the scope of the appended claims.

I claim:

1. A jack for moving a tubular first member and a second member extending therethrough relative to one another, comprising:

a first gripping unit adapted to extend about said tubular first member and actuable between an active condition in which it grips an outer surface of said first member to apply jacking force thereto in a first axial direction and a released condition permitting movement of the gripping unit relative to said first member in said axial direction;

a second gripping unit adapted to extend about said second member axially beyond said first member and actuable between an active gripping condition in which it grips an outer surface of said second member smaller in diameter than said outer surface of the first member in a relation to apply jacking force thereto in said second axial direction and a released condition permitting movement of the second gripping unit relative to said second member in said second axial direction; and power actuated means for moving said gripping units axially relative to one another in a direction applying force from said first gripping unit to said tubular member in said first axial direction and applying force from said second gripping unit to second member in said second axial direction to jack the members axially relative to one another.

2. A jack as recited in claim 1, in which each of said gripping units includes a slip bowl and tapered slip means engageable with the slip bowl in a camming relation to grip the associated one of said members, with the slip means of the two units being constructed and adapted to grip said two members at different diameters respectively.

3. A jack as recited in claim 1, in which said power actuated means include at least one piston and cylinder mechanism operable to actuate said gripping units axially relative to one another.

4. A marine platform jacket jack for raising a tubular member forming a portion of a jacket relative to a pile extending through the member, comprising:

a first gripping unit adapted to extend about said tubular member and actuable between an active condition in which it grips an outer surface of said member to apply upward jacking force from said gripping unit to said member and a released condition permitting upward movement of the gripping unit relative to said member;

a second gripping unit adapted to extend about said pile above said tubular member and actuable between an active condition in which it grips an outer surface of the pile smaller in diameter than said outer surface of said member in a relation preventing downward movement of the second gripping unit relative to the pile and a released condition permitting such movement; and power actuated means for moving said first gripping unit upwardly relative to said second gripping unit to jack said tubular member upwardly relative to the pile.

5. A marine platform jacket jack as recited in claim 4, in which each of said gripping units includes a slip bowl structure and tapered slips engaging said bowl structure in a camming relation to grip a corresponding one of said members;

said slips of the two units being tapered in opposite directions to apply upward force to said tubular member and downward force to said pile.

6. A marine platform jacket jack as recited in claim 4, in which said power actuated means include piston and cylinder means operable to move said first gripping unit upwardly relative to said second gripping unit.

7. A marine platform jacket jack as recited in claim 4, in which each of said gripping units is power actuable between said active gripping condition and said released condition thereof.

8. A marine platform jacket jack as recited in claim 4, in which each of said gripping units includes a slip bowl structure, tapered slips adapted to be cammed against a tubular member or pile by said bowl structure, and powered means for actuating said slips relative to said slip bowl structure and between said active and released conditions.

9. A marine platform jacket jack as recited in claim 4, including a sleeve receivable about said tubular member or pile axially between said gripping units and carrying said power actuated means.

10. A marine platform jacket jack as recited in claim 4, including a downwardly facing stabbing guide beneath said first gripping unit having an inwardly tapering guide surface engageable with an upper end of said tubular member in a relation to direct said tubular member into properly centered relation with respect to said first gripping unit.

11. A marine platform jacket jack as recited in claim 4, including an upwardly facing centering guide above said second gripping unit having a downwardly tapering inner guide surface engageable with a pile to center it with respect to said second gripping unit.

12. A marine platform jacket jack for raising a tubular member forming a position of a jacket relative to a pile extending through the member, comprising:

a first gripping unit adapted to extend about said tubular member and including a slip bowl structure having a downwardly tapering camming surface, downwardly tapering slips engageable with said bowl structure to grip an outer surface of said tubular member, and power actuated means for moving said slips relative to said slip bowl structure between an active position in which the slips grip an outer surface of said tubular member to apply upward jacking force thereto and a released position permitting upward movement of said gripping unit relative to said tubular member;

a second gripping unit adapted to extend about said pile above said tubular member and including a slip bowl structure having an upwardly tapering camming surface, upwardly tapering slips engageable with said slip bowl structure to grip an outer surface of the pile smaller in diameter than said outer surface of said tubular member, and power actuated means for moving said slips of the second gripping unit relative to said bowl structure thereof between active positions in which the slips grip said outer surface of the pile in a relation preventing downward movement of the second gripping unit relative to the pile and a released position permitting such movement; and fluid pressure operated piston and cylinder means for moving the slip bowl structure of said first gripping unit upwardly relative to the slip bowl structure of said second gripping unit to jack said tubular member upwardly relative to the pile.

13. A marine platform jacket jack as recited in claim 12, including a tubular sleeve receivable about said pile between said two gripping units.

14. A marine platform jacket jack as recited in claim 12, including a tubular sleeve receivable about said pile between said two gripping units and carrying said piston and cylinder means.

15. A marine platform jacket jack as recited in claim 12, including a tubular sleeve receivable about said pile between said two gripping units and attached to said slip bowl structure of the second gripping unit.

16. A marine platform jacket jack as recited in claim 12, including a tubular sleeve receivable about said pile between said two gripping units and attached to said slip bowl structure of the second gripping unit and to said piston and cylinder means.

17. A marine platform jacket jack as recited in claim 16, in which each of said power actuated means of the two gripping units includes an element receivable about said tubular member or said pile and connected to the slips of the corresponding gripping unit to move them axially, and piston and cylinder means for actuating said element relative to a corresponding one of said slip bowl structures.

18. A marine platform jacket jack as recited in claim 17, including a first stabbing guide connected to said slip bowl structure of said first gripping unit and defining a downwardly flaring centering surface, and a second stabbing guide connected to the slip bowl structure of said second gripping unit and having an upwardly flaring centering surface.

* * * * *